US009412322B2

(12) United States Patent
Zhao

(10) Patent No.: US 9,412,322 B2
(45) Date of Patent: Aug. 9, 2016

(54) LIQUID CRYSTAL DISPLAY DEVICE AND METHOD FOR DRIVING SAME

(75) Inventor: Dengxia Zhao, Shenzhen (CN)

(73) Assignee: SHENZHEN CHINA STAR OPTOELECTRONICS TECHNOLOGY CO., LTD., Shenzhen, Guangdong Province (CN)

( * ) Notice: Subject to any disclaimer, the term of this patent is extended or adjusted under 35 U.S.C. 154(b) by 469 days.

(21) Appl. No.: 13/260,369

(22) PCT Filed: May 5, 2011

(86) PCT No.: PCT/CN2011/073714

§ 371 (c)(1),
(2), (4) Date: Sep. 25, 2011

(87) PCT Pub. No.: WO2012/139312

PCT Pub. Date: Oct. 18, 2012

(65) Prior Publication Data

US 2012/0262440 A1 Oct. 18, 2012

(51) Int. Cl.
*G09G 3/36* (2006.01)

(52) U.S. Cl.
CPC ..... *G09G 3/3677* (2013.01); *G09G 3/3696* (2013.01); *G09G 2320/0209* (2013.01); *G09G 2320/0247* (2013.01); *G09G 2320/0257* (2013.01); *G09G 2320/0295* (2013.01); *G09G 2320/043* (2013.01)

(58) Field of Classification Search
CPC ..... G09G 3/3655; G09G 2320/0209; G09G 2320/0426; G09G 2320/043; G09G 2320/0257
USPC ..... 345/87–104, 204
See application file for complete search history.

(56) References Cited

U.S. PATENT DOCUMENTS

| | | | | |
|---|---|---|---|---|
| 8,514,162 | B2 * | 8/2013 | Moh et al. | 345/94 |
| 2003/0001812 | A1 * | 1/2003 | Lee et al. | 345/94 |
| 2005/0253836 | A1 * | 11/2005 | Kim et al. | 345/212 |
| 2007/0024565 | A1 * | 2/2007 | Choi | 345/98 |

FOREIGN PATENT DOCUMENTS

| | | | |
|---|---|---|---|
| CN | 101320170 | A | 12/2008 |
| CN | 101408705 | A | 4/2009 |
| CN | 101694765 | A | 4/2010 |
| JP | 3-253817 | A | 11/1991 |
| KR | 2002-0091689 | A | 12/2002 |
| KR | 10-0448936 | B1 | 9/2004 |

* cited by examiner

*Primary Examiner* — Jose Soto Lopez
(74) *Attorney, Agent, or Firm* — Cheng-Ju Chiang

(57) ABSTRACT

An exemplary liquid crystal display device includes a liquid crystal panel, a common voltage generator and a scanning voltage regenerator. The liquid crystal panel includes a plurality of pixel regions formed in a matrix form. Each pixel region includes a thin-film transistor and a storage capacitor. The storage capacitor includes a pixel electrode and a storage electrode facing the pixel electrode. The common voltage generator is configured for providing a common voltage to the storage electrode. The scanning voltage regenerator is configured for receiving a feedback common voltage from the storage electrode and generating a regenerated scanning voltage for driving the thin-film transistor according to the feedback common voltage.

8 Claims, 3 Drawing Sheets

LIQUID CRYSTAL DISPLAY DEVICE AND METHOD FOR DRIVING SAME

TECHNICAL FIELD

The present disclosure generally relates to liquid crystal display (LCD) devices, and more particularly relates to a liquid crystal display device and a method for driving the liquid crystal display device.

BACKGROUND

At present, liquid crystal display devices are widely used in various electronic devices, such as computer monitors, TVs, notebooks, mobile phones and digital cameras, due to their advantages, such as slim shape, energy saving and low radiation.

Referring to FIG. 1, a circuit diagram of a typical liquid crystal display device 10 is shown. The liquid crystal display device 10 includes a liquid crystal panel 11, a scanning voltage generator 12, a scanning driver 13, a data driver 14 and a common voltage generator 15. The scanning driver 13 and the data driver 14 are configured for driving the liquid crystal panel 11. The common voltage generator 15 is configured for providing a common voltage VCOM to the liquid crystal panel 11. The scanning voltage generator 12 is configured for providing a first scanning voltage VGL and a second scanning voltage VGH to the scanning driver 13.

The liquid crystal panel 11 includes a plurality of parallel scanning lines 131, and a plurality of parallel data lines 141 orthogonal to and isolated from the scanning lines 131. The scanning lines 131 and the data lines 141 are configured for defining a plurality of pixel regions 102. Each pixel region 102 includes a thin-film transistor (TFT) 103 arranged in a vicinity of an intersecting point of the scanning lines 131 and the data lines 141, a liquid crystal capacitor 104 and a storage capacitor 105.

The liquid crystal capacitor 104 includes a pixel electrode 1041, a common electrode 1042 and a liquid crystal layer (not shown) sandwiched between the pixel electrode 1041 and the common electrode 1042. The storage capacitor 105 includes the pixel electrode 1041, a storage electrode 1051 and an insulating layer (not shown) sandwiched between the pixel electrode 1041 and the storage electrode 1051.

The thin-film transistor 103 includes a gate electrode (not labeled) connected to one of the scanning lines 131, a source electrode (not labeled) connected to one of the data lines 141 and a drain electrode (not labeled) connected to the pixel electrode 1041.

The scanning voltage generator 12 is configured for providing the first scanning voltage VGL and the second scanning voltage VGH to the scanning driver 13. The scanning driver 13 is configured for providing a plurality of scanning signals to each scanning line 131 successively according to the first scanning voltage VGL and the second scanning voltage VGH. When the scanning driver 13 provides the scanning signal to one of the scanning lines 131 connected to the thin-film transistor 103 according to the second scanning voltage VGH, the thin-film transistor 103 is conducted. The data driver 14 is configured for providing a plurality of grayscale voltages to the plurality of data lines 141 so that one of the grayscale voltages may be provided to the pixel electrode 1041 via the source electrode and the drain electrode of the conducted thin-film transistor 103.

The common voltage VCOM generated by the common voltage generator 15 is provided to the common electrode 1042 and the storage electrode 1051, respectively. When one of the grayscale voltages is provided to the pixel electrode 1041 via the source electrode and the drain electrode of the conducted thin-film transistor 103, a voltage difference is generated by the common voltage VCOM and the grayscale voltage between the pixel electrode 1041 and the common electrode 1042 of the liquid crystal capacitor 104. Liquid crystal molecules in the liquid crystal layer sandwiched between the pixel electrode 1041 and the common electrode 1042 may be induced to a predetermined angle in order to achieve a predetermined gray-level according to the angle of the liquid crystal molecules. The storage capacitor 105 is configured for maintaining the grayscale voltage on the pixel electrode 1041, so that the grayscale voltage on the pixel electrode 1041 may be maintained until a successive grayscale voltage is provided to the pixel electrode 1041.

In general, there is a parasitic capacitor 106 between the gate electrode and the drain electrode of the thin-film transistor 103. When the voltage on the gate electrode of the thin-film transistor 103 changes, for example from the second scanning voltage VGH to the first scanning voltage VGL, the voltage on the pixel electrode 1041 changes correspondingly, because the voltage difference on the parasitic capacitor 106 cannot change instantly. Furthermore, the common voltages VCOM on the storage electrode 1051 and the common electrode 1042 changes correspondingly, because the voltage differences on the storage capacitor 105 and the liquid crystal capacitor 104 cannot change instantly. Therefore, a picture displayed on the liquid crystal panel 11 may flicker due to the changes of the common voltages VCOM on the storage electrode 1051 and the common electrode 1042.

What is needed, therefore, is a liquid crystal display device and a method for driving the liquid crystal display device which may overcome above problems.

SUMMARY

Accordingly, the present disclosure provides a liquid crystal display device and a method for driving the liquid crystal display device which may reduce or even eliminate the picture flickering caused by the change of the common voltage.

The present disclosure provides an liquid crystal display device which includes a liquid crystal panel, a common voltage generator, a scanning voltage regenerator and a scanning driver. The liquid crystal panel includes a plurality of scanning lines, a plurality of data lines orthogonal to and isolated from the plurality of data lines, and a plurality of pixel regions defined by the scanning lines and the data lines. Each pixel region includes a storage capacitor and a thin-film transistor. The storage capacitor includes a pixel electrode and a storage electrode facing the pixel electrode. The thin-film transistor includes a gate electrode connected to one of the plurality of scanning lines, a source electrode connected to one of the plurality of data lines and a drain electrode connected to the pixel electrode. The common voltage generator is configured for providing a common voltage to the storage electrode. The scanning voltage regenerator includes a capacitor and an adder. The adder includes a first voltage input terminal, a second voltage input terminal and a voltage output terminal. The first voltage input terminal is configured for receiving a feedback common voltage via the capacitor from the storage electrode. The second voltage input terminal is configured for receiving a first scanning voltage for cutting-off the thin-film transistor. The voltage output terminal is configured for outputting a regenerated scanning voltage generated by adding an alternating current component of the feedback common voltage to the first scanning voltage. The scanning driver is configured for receiving the regenerated scanning voltage and a second scanning voltage for conducting the thin-film transistor, and outputting a plurality of scanning signals to each scanning line successively according to the regenerated scanning voltage and the second scanning voltage.

The present disclosure provides an liquid crystal display device which includes a liquid crystal panel, a common voltage generator and a scanning voltage regenerator. The liquid crystal panel includes a plurality of pixel regions formed in a matrix form. Each pixel region includes a thin-film transistor and a storage capacitor. The storage capacitor includes a pixel electrode and a storage electrode facing the pixel electrode. The common voltage generator is configured for providing a common voltage to the storage electrode. The scanning voltage regenerator is configured for receiving a feedback common voltage from the storage electrode and generating a regenerated scanning voltage for driving the thin-film transistor according to the feedback common voltage.

According to an exemplary embodiment of the present disclosure, the liquid crystal panel includes a plurality of scanning lines and a plurality of data lines. The plurality of scanning lines is orthogonal to and isolated from the plurality of data lines to define the plurality of pixel regions. The thin-film transistor includes a gate electrode connected to one of the plurality of scanning lines, a source electrode connected to one of the plurality of data lines and a drain electrode connected to the pixel electrode.

According to an exemplary embodiment of the present disclosure, the scanning voltage regenerator includes a blocking element and an adder. The adder includes a first voltage input terminal, a second voltage input terminal and a voltage output terminal. The first voltage input terminal is configured for receiving the feedback common voltage via the blocking element. The second voltage input terminal is configured for receiving a first scanning voltage for cutting-off the thin-film transistor. The voltage output terminal is configured for outputting the regenerated scanning voltage generated by adding an alternating current component of the feedback common voltage to the first scanning voltage.

According to an exemplary embodiment of the present disclosure, the blocking element is a capacitor.

According to an exemplary embodiment of the present disclosure, the liquid crystal display device further includes a scanning driver. The scanning driver is configured for receiving the regenerated scanning voltage and a second scanning voltage for conducting the thin-film transistor, and outputting a plurality of scanning signals to each scanning line successively according to the regenerated scanning voltage and the second scanning voltage.

According to an exemplary embodiment of the present disclosure, the liquid crystal display device further includes a scanning voltage generator configured for providing the first scanning voltage and the second scanning voltage.

According to an exemplary embodiment of the present disclosure, the liquid crystal display device further includes a data driver configured for providing a plurality of grayscale voltages to the data lines when the thin-film transistor is conducted.

The present disclosure provides a method for driving a liquid crystal display device. The liquid crystal display device includes a liquid crystal panel and a common voltage generator. The liquid crystal panel includes a plurality of pixel regions formed in a matrix form. Each pixel region includes a thin-film transistor and a storage capacitor. The storage capacitor includes a pixel electrode and a storage electrode facing the pixel electrode. The common voltage generator is configured for providing a common voltage to the storage electrode. The method includes receiving a feedback common voltage from the storage electrode; generating a regenerated scanning voltage according to the feedback common voltage; and driving the thin-film transistor with the regenerated scanning voltage.

According to an exemplary embodiment of the present disclosure, the step of generating the regenerated scanning voltage according to the feedback common voltage includes adding an alternating current component of the feedback common voltage to a first scanning voltage for cutting-off the thin-film transistor.

According to an exemplary embodiment of the present disclosure, the step of driving the thin-film transistor with the regenerated scanning voltage includes receiving the regenerated scanning voltage and a second scanning voltage for conducting the thin-film transistor, and outputting a plurality of scanning signals to each scanning line in the liquid crystal panel successively according to the regenerated scanning voltage and the second scanning voltage to drive the thin-film transistor.

The liquid crystal display device and the method for driving the liquid crystal display device provided in the present disclosure may generate a regenerated scanning voltage according to a feedback common voltage, and drive thin-film transistors with the regenerated scanning voltage. Thus, the change of the common voltage may be compensated, and the flickering of picture caused by the change of the common voltage may be reduced or even eliminated.

BRIEF DESCRIPTION OF THE DRAWINGS

The components in the drawings are not necessarily drawn to scale, the emphasis instead being placed upon clearly illustrating the principles of at least one embodiment of the present disclosure. In the drawings, like reference numerals designate corresponding parts throughout various views, and all the views are schematic.

DETAILED DESCRIPTION OF EMBODIMENTS

Reference will now be made to the drawings to describe preferred and exemplary embodiments of the present disclosure in detail.

Figure 1:
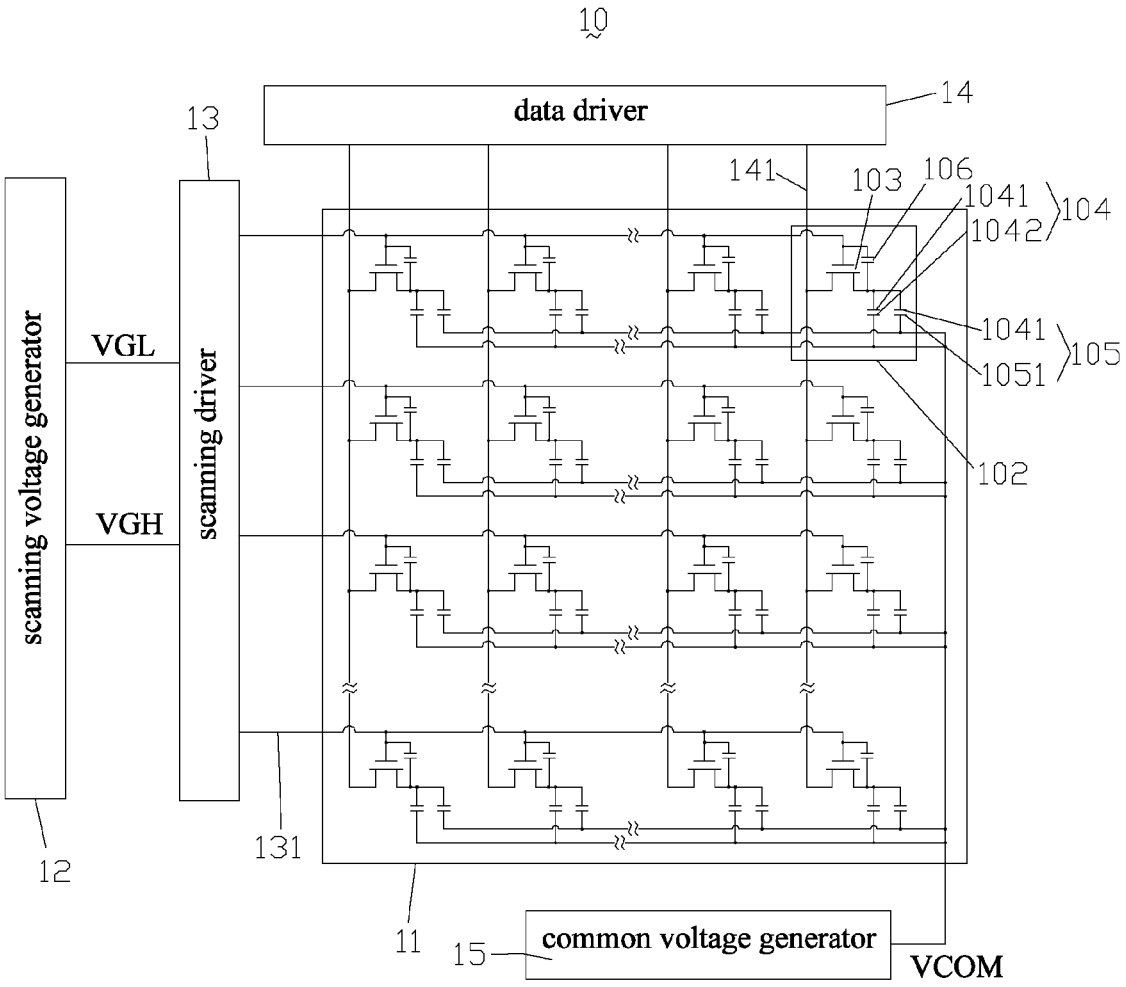
FIG. 1 (RELATED ART)
FIG. 1 shows a circuit diagram of a conventional liquid crystal display device.
Figure 2:
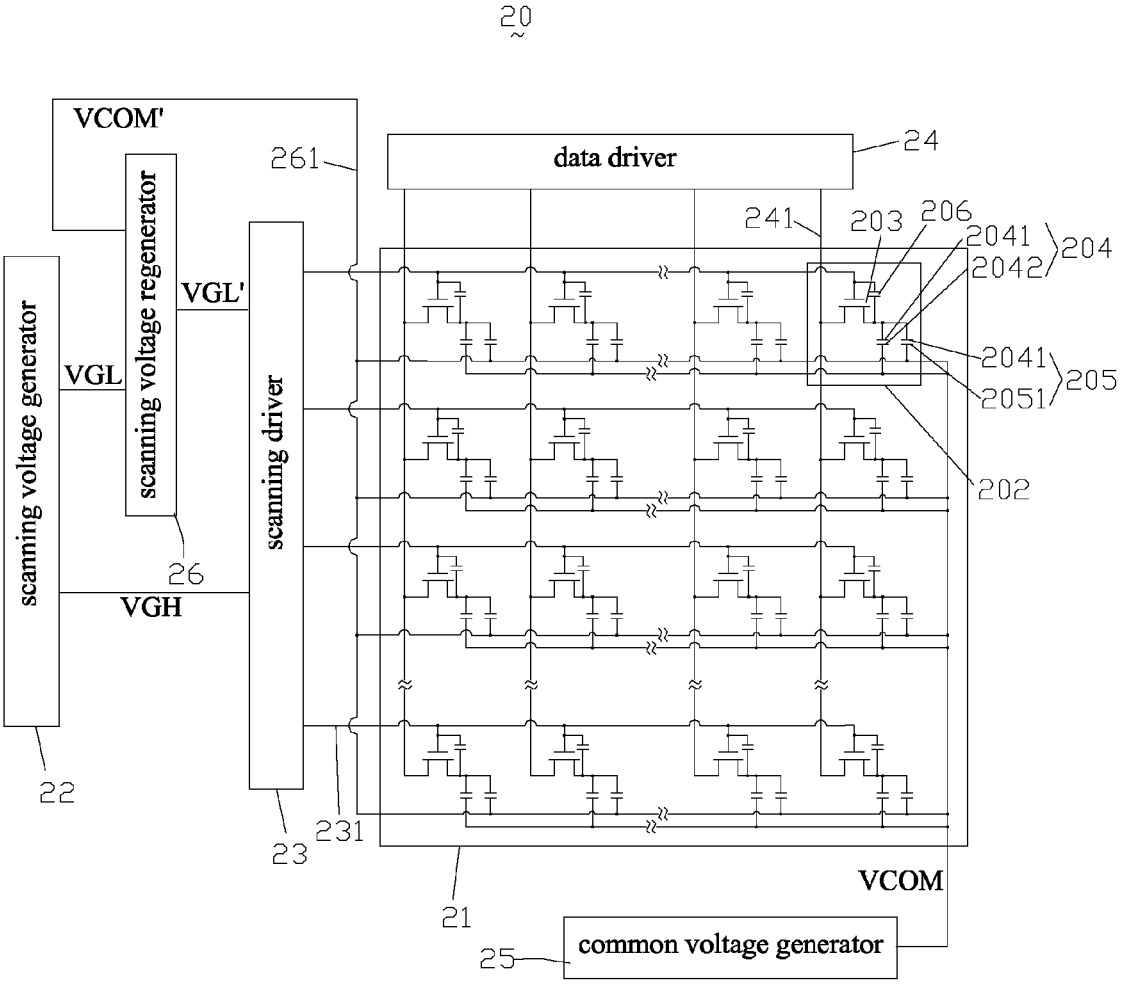
FIG. 2 shows a circuit diagram of a liquid crystal display device according to an exemplary embodiment of the present disclosure.

Referring to FIG. 2, a circuit diagram of a liquid crystal display device 20 according to an exemplary embodiment of the present disclosure is shown. The liquid crystal display device 20 includes a liquid crystal panel 21, a scanning voltage generator 22, a scanning driver 23, a data driver 24, a common voltage generator 25 and a scanning voltage regenerator 26.

The liquid crystal panel 21 includes a plurality of scanning lines 231 and a plurality of data lines 241. The scanning lines 231 are orthogonal to and isolated from the data lines 241, so that a plurality of pixel regions 202 may be defined in a matrix form. Each pixel region 202 includes a thin-film transistor 203, a liquid crystal capacitor 204 and a storage capacitor 205.

The liquid crystal capacitor 204 includes a pixel electrode 2041, a common electrode 2042 facing the pixel electrode 2041 and a liquid crystal layer (not shown) sandwiched between the pixel electrode 2041 and the common electrode 2042. The storage capacitor 205 includes the pixel electrode 2041, a storage electrode 2051 facing the pixel electrode 2041 and an insulating layer (not shown) sandwiched between the pixel electrode 2041 and the storage electrode 2051.

The thin-film transistor 203 includes a gate electrode (not labeled), a source electrode (not labeled) and a drain electrode (not labeled). The gate electrode is connected to one of the scanning lines 231. The source electrode is connected to one of the data lines 241. The drain electrode is connected to the pixel electrode 2041. There is a parasitic capacitor 206 cooperatively formed by the source electrode and the drain electrode of the thin-film transistor 203.

The scanning voltage generator 22 is configured for providing a first scanning voltage VGL for cutting-off the thin-film transistor 203 and a second scanning voltage VGH for conducting the thin-film transistor 203. The common voltage generator 25 is configured for providing a common voltage VCOM to the common electrode 2042 and the storage electrode 2051, respectively.

The scanning voltage regenerator 26 is connected to the storage electrode 2051 in each pixel region 202 via a feedback line 261, and is configured for receiving a feedback common voltage VCOM' from the storage electrode 2051. The scanning voltage regenerator 26 is further configured for generating a regenerated scanning voltage VGL' for driving the thin-film transistor 203 according to the feedback common voltage VCOM'. The scanning driver 13 is configured for receiving the regenerated scanning voltage VGL' and the second scanning voltage VGH, and outputting a plurality of scanning signals to each scanning line 231 successively according to the regenerated scanning voltage VGL' and the second scanning voltage VGH.

Figure 3:
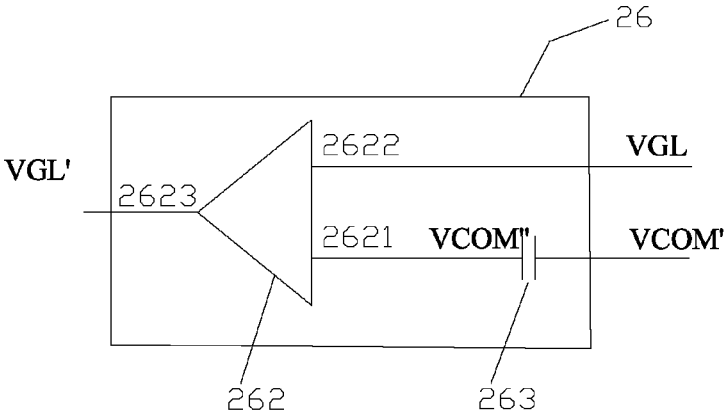
FIG. 3 shows a circuit diagram of a scanning voltage regenerator of the liquid crystal display device shown in FIG. 2 according to an exemplary embodiment of the present disclosure.

Referring to FIG. 3, a circuit diagram of the scanning voltage regenerator 26 of the liquid crystal display device 20 according to an exemplary embodiment of the present disclosure is shown. The scanning voltage regenerator 26 includes an adder 262 and a blocking element 263. The adder 262 includes a first voltage input terminal 2621, a second voltage input terminal 2622 and a voltage output terminal 2623.

The first voltage input terminal 2621 is configured for receiving the feedback common voltage VCOM' via the blocking element 263. The blocking element 263 is configured for filtering a direct current (DC) component of the feedback common voltage VCOM', and outputting an alternating current (AC) component VCOM" of the feedback common voltage VCOM' to the first voltage input terminal 2621. In the present embodiment, the blocking element 263 is a capacitor. In alternative embodiments, the blocking element 263 may be any element or circuit that may filter the direct current component of the feedback common voltage VCOM' and pass the alternating current component VCOM" of the feedback common voltage VCOM'. The second voltage input terminal 2622 is configured for receiving the first scanning voltage VGL for cutting-off the thin-film transistor 203. The voltage output terminal 2623 is configured for outputting the regenerated scanning voltage VGL'. The regenerated scanning voltage VGL' is generated by adding the alternating current component VCOM" of the feedback common voltage VCOM' to the first scanning voltage VGL:

$$VGL' = VCOM'' + VGL \quad (1)$$

The scanning driver 23 is configured for receiving the regenerated scanning voltage VGL', and selectively providing the regenerated scanning voltage VGL' to one of the scanning lines 231 connected to the thin-film transistor 203 in order to cut-off the thin-film transistor 203. The scanning driver 23 is further configured for receiving the second scanning voltage VGH and selectively providing the second scanning voltage VGH to one of the scanning lines 231 connected to the thin-film transistor 203 in order to conduct the thin-film transistor 203.

When the thin-film transistor 203 is conducted, the data driver 24 is configured for providing a plurality of grayscale voltages to the data lines 241. One of the grayscale voltages is provided to the pixel electrode 2041 via the source electrode and the drain electrode of the conducted thin-film transistor 203. In the present embodiment, the regenerated scanning voltage VGL' and the second scanning voltage VGH may be provided to the scanning lines 231, and the grayscale voltages may be provide to the data lines 241 by well-known means, which will be not described in detail.

While the voltage on the gate electrode of the thin-film transistor 203 changes, for example from the second scanning voltage VGH to the first scanning voltage VGL, the common voltages VCOM on the storage electrode 2051 and the common electrode 2042 change correspondingly, due to the existences of the parasitic capacitor 206, the storage capacitor 205 and the liquid crystal capacitor 204. The scanning voltage regenerator 26 may adjust the first scanning voltage VGL and generate the regenerated scanning voltage VGL' correspondingly to the change of the feedback common voltage VCOM' (i.e. the alternating current component VCOM"). The regenerated scanning voltage VGL' provided to the gate electrode of the thin-film transistor 203 may change synchronously to the common voltages VCOM on the storage electrode 2051 and the common electrode 2042. Thus, the flickering of the picture displayed on the liquid crystal panel 21 caused by the change of the common voltages VCOM may be reduced or even eliminated.

It should be noted that only one scanning voltage regenerator 26 is configured in the liquid crystal display device 20 and is connected to the storage electrode 2051 in each pixel region 202 in the liquid crystal panel 21. Therefore, the scanning voltage regenerator 26 receives the feedback common voltage VCOM' from all the storage electrodes 2051 in the liquid crystal panel 21. However, a plurality of scanning voltage regenerators 26 may be configured in the liquid crystal display device 20. For example, each scanning voltage regenerator 26 may correspond to one row of the pixel regions 202 or any predetermined amount of the pixel regions 202.

Figure 4:
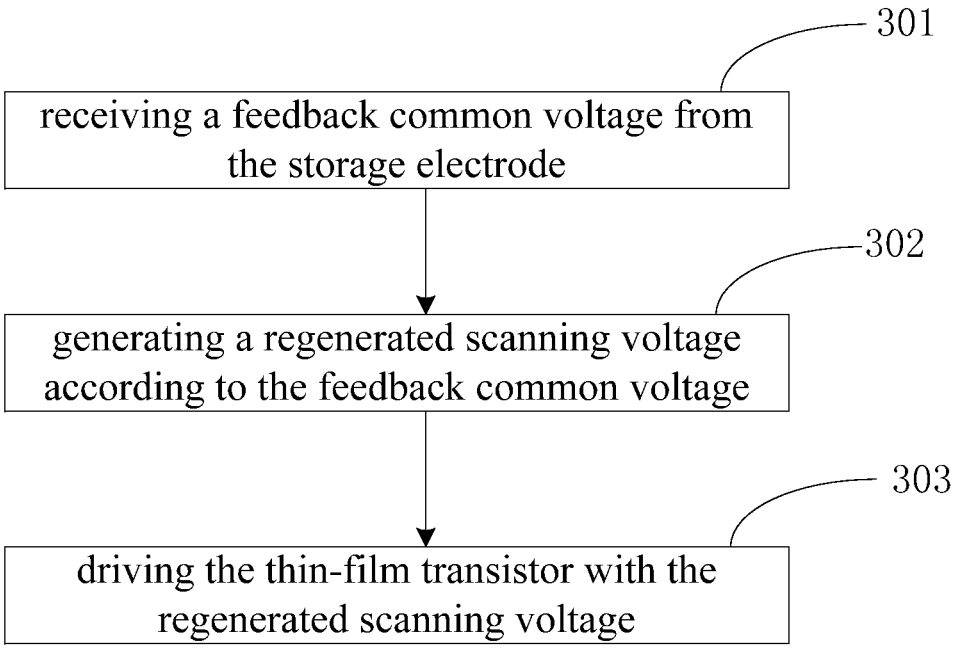
FIG. 4 shows a flow diagram of a method for driving the liquid crystal display device shown in FIG. 2 according to an exemplary embodiment of the present disclosure.

Referring to FIG. 4, a flow diagram of a method for driving the liquid crystal display device 20 according to an exemplary embodiment of the present disclosure is shown. The method includes following steps.

In step 301, the feedback common voltage VCOM' is received from the storage electrode 2051.

In step 302, the regenerated scanning voltage VGL' is generated according to the feedback common voltage VCOM'. In a preferred embodiment, the regenerated scanning voltage VGL' is generated by adding the alternating current component VCOM" of the feedback common voltage VCOM' to the first scanning voltage VGL for cutting-off the thin-film transistor 203.

In step 303, the regenerated scanning voltage VGL' may be configured for driving the thin-film transistor 203.

In the method mentioned above, the steps 301 and 302 may be performed by the scanning voltage regenerator 26 shown in FIG. 2, and the step 303 may be performed by the scanning driver 23 shown in FIG. 2. The detailed performing process has been described above and will be omitted here.

As is mentioned above, the liquid crystal display device and the method for driving the liquid crystal display device provided in the present disclosure may generate a regenerated scanning voltage according to a feedback common voltage, and drive thin-film transistors with the regenerated scanning voltage. Thus, the change of the common voltage may be compensated, and the flickering of picture caused by the change of the common voltage may be reduced or even eliminated.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A liquid crystal display device comprising:

a liquid crystal panel comprising a plurality of scanning lines, a plurality of data lines orthogonal to and isolated from the plurality of scanning lines, and a plurality of pixel regions defined by the scanning lines and the data lines, each pixel region comprising a storage capacitor and a thin-film transistor, the storage capacitor comprising a pixel electrode and a storage electrode facing the pixel electrode, the thin-film transistor comprising a gate electrode connected to one of the plurality of scanning lines, a source electrode connected to one of the plurality of data lines and a drain electrode connected to the pixel electrode;

a common voltage generator configured for providing a common voltage to the storage electrode;

a scanning voltage regenerator comprising a capacitor and an adder, the adder comprising a first voltage input terminal, a second voltage input terminal and a voltage output terminal, the first voltage input terminal being configured for receiving a feedback common voltage via the capacitor from the storage electrode, the second voltage input terminal being configured for receiving a first scanning voltage for cutting-off the thin-film transistor, the voltage output terminal being configured for outputting a regenerated scanning voltage generated by adding an alternating current component of the feedback common voltage to the first scanning voltage; and a scanning driver configured for receiving the regenerated scanning voltage and a second scanning voltage for conducting the thin-film transistor, and outputting a plurality of scanning signals to each scanning line successively according to the regenerated scanning voltage and the second scanning voltage, each of the scanning signals being consisted of the regenerated scanning voltage and the second scanning voltage, the regenerated scanning voltage and the second scanning voltage being provided to the gate electrode of the thin-film transistor;

wherein the scanning voltage regenerator uses the adder to output the regenerated scanning voltage generated by adding the alternating current component of the feedback common voltage to the first scanning voltage, so as to make the regenerated scanning voltage change synchronously with the change of the common voltage, to reduce or eliminate picture flickering caused by the change of the common voltage.

2. A liquid crystal display device comprising:

a liquid crystal panel comprising a plurality of pixel regions formed in a matrix form, each pixel region comprising a thin-film transistor and a storage capacitor, the storage capacitor comprising a pixel electrode and a storage electrode facing the pixel electrode;

a common voltage generator configured for providing a common voltage to the storage electrode; and a scanning voltage regenerator configured for receiving a feedback common voltage from the storage electrode and generating a regenerated scanning voltage for driving the thin-film transistor according to the feedback common voltage;

wherein the scanning voltage regenerator comprises a blocking element and an adder, the adder comprising a first voltage input terminal, a second voltage input terminal and a voltage output terminal, the first voltage input terminal being configured for receiving the feedback common voltage via the blocking element, the second voltage input terminal being configured for receiving a first scanning voltage for cutting-off the thin-film transistor, the voltage output terminal being configured for outputting the regenerated scanning voltage generated by adding an alternating current component of the feedback common voltage to the first scanning voltage, the regenerated scanning voltage being provided to a gate electrode of the thin-film transistor;

wherein the scanning voltage regenerator uses the adder to output the regenerated scanning voltage generated by adding the alternating current component of the feedback common voltage to the first scanning voltage, so as to make the regenerated scanning voltage change synchronously with the change of the common voltage, to reduce or eliminate picture flickering caused by the change of the common voltage.

3. The liquid crystal display device of claim 2, wherein the liquid crystal panel comprises a plurality of scanning lines and a plurality of data lines, the plurality of scanning lines being orthogonal to and isolated from the plurality of data lines to define the plurality of pixel regions, the thin-film transistor comprising a gate electrode connected to one of the plurality of scanning lines, a source electrode connected to one of the plurality of data lines and a drain electrode connected to the pixel electrode.

4. The liquid crystal display device of claim 2, wherein the blocking element is a capacitor.

5. The liquid crystal display device of claim 3, wherein the liquid crystal display device further comprises a scanning driver, the scanning driver being configured for receiving the regenerated scanning voltage and a second scanning voltage for conducting the thin-film transistor, and outputting a plurality of scanning signals to each scanning line successively according to the regenerated scanning voltage and the second scanning voltage.

6. The liquid crystal display device of claim 5, wherein the liquid crystal display device further comprises a scanning voltage generator configured for providing the first scanning voltage and the second scanning voltage.

7. The liquid crystal display device of claim 3, wherein the liquid crystal display device further comprises a data driver configured for providing a plurality of grayscale voltages to the data lines when the thin-film transistor is conducted.

8. A method for driving a liquid crystal display device, the liquid crystal display device comprising a liquid crystal panel and a common voltage generator, the liquid crystal panel comprising a plurality of pixel regions formed in a matrix form, each pixel region comprising a thin-film transistor and a storage capacitor, the storage capacitor comprising a pixel electrode and a storage electrode facing the pixel electrode, the common voltage generator being configured for providing a common voltage to the storage electrode, wherein the method comprises:

receiving a feedback common voltage from the storage electrode;

generating a regenerated scanning voltage according to the feedback common voltage; and driving the thin-film transistor with the regenerated scanning voltage;

wherein the step of generating the regenerated scanning voltage according to the feedback common voltage comprises adding an alternating current component of the feedback common voltage to a first scanning voltage for cutting-off the thin-film transistor;

wherein the step of driving the thin-film transistor with the regenerated scanning voltage comprises receiving the regenerated scanning voltage and a second scanning voltage for conducting the thin-film transistor, and outputting a plurality of scanning signals to each scanning line in the liquid crystal panel successively according to the regenerated scanning voltage and the second scanning voltage to drive the thin-film transistor, each of the scanning signals being consisted of the regenerated scanning voltage and the second scanning voltage, the regenerated scanning voltage and the second scanning voltage being provided to the gate electrode of the thin-film transistor;

wherein the regenerated scanning voltage is generated by adding the alternating current component of the feedback common voltage to the first scanning voltage, so as to make the regenerated scanning voltage change synchronously with the change of the common voltage, to reduce or eliminate picture flickering caused by the change of the common voltage.

* * * * *